US006896151B1

(12) United States Patent
Robinson

(10) Patent No.: US 6,896,151 B1
(45) Date of Patent: May 24, 2005

(54) SELF-CLOSING FLUID DISPENSING CLOSURE

(75) Inventor: Philip J. Robinson, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 293 days.

(21) Appl. No.: 10/287,841

(22) Filed: Nov. 4, 2002

(51) Int. Cl.[7] ..... B65D 37/00; G01F 11/00
(52) U.S. Cl. ..... 222/1; 222/212; 222/494
(58) Field of Search ..... 222/1, 212, 491, 222/494, 495, 496, 497

(56) References Cited

U.S. PATENT DOCUMENTS

| | | | | |
|---|---|---|---|---|
| 3,231,149 A | | 1/1966 | Yuza | 222/324 |
| 4,349,134 A | | 9/1982 | Schuster et al. | 222/212 |
| 4,699,300 A | | 10/1987 | Blake | 222/494 |
| 5,092,855 A | * | 3/1992 | Pardes | 604/247 |
| 5,226,568 A | | 7/1993 | Newton et al. | 222/212 |
| 5,447,258 A | | 9/1995 | Suzuki | 222/494 |
| 5,779,109 A | | 7/1998 | Gueret | 222/494 |
| 5,906,597 A | | 5/1999 | McPhee | 604/246 |
| 5,971,224 A | | 10/1999 | Garibaldi | 222/207 |
| 6,116,475 A | | 9/2000 | Delage | 222/494 |
| 6,145,707 A | * | 11/2000 | Baudin | 222/189.09 |
| 6,309,059 B1 | | 10/2001 | Ritter | 347/86 |
| 6,325,253 B1 | | 12/2001 | Robinson | 222/212 |
| 6,386,395 B1 | | 5/2002 | Lunghetti | 222/213 |
| 6,443,370 B1 | * | 9/2002 | Brulle et al. | 239/333 |
| 6,536,631 B1 | * | 3/2003 | Nickels et al. | 222/212 |
| 6,662,977 B2 | * | 12/2003 | Gerber et al. | 222/494 |

* cited by examiner

*Primary Examiner*—Joseph A. Kaufman

(57) ABSTRACT

A fluid dispensing closure includes a housing having a base for securement to a container and a peripheral wall extending from the base toward an open end spaced from the base. A flexible resilient liner is captured within the peripheral wall of the housing, and has a flange extending through the open end of the housing peripheral wall. A flow tip has a body captured within the liner and an outer end extending through the open end of the housing peripheral wall and through the flange of the flexible resilient liner. The flow tip has at least two fluid flow passages disposed within the liner, and a circumferential channel underlying the flange and interconnecting ends of the passages. Pressure applied to the flange by fluid in the passages and channel expands the flange away from the flow tip and channel to permit egress of fluid from the channel, and removal of such pressure allows resilient collapse of the flange over the channel to seal the passages. The circumferential channel provides improved control of fluid flow from the dispensing closure.

16 Claims, 3 Drawing Sheets

SELF-CLOSING FLUID DISPENSING CLOSURE

The present invention is directed to closures for dispensing fluids from container packages, and more particularly to a closure, method of manufacture and fluid dispensing package in which the closure opens to dispense fluid under pressure from within the container and is self-closing when the fluid pressure is removed to prevent return of fluid or flow of other contaminants into the container.

BACKGROUND AND SUMMARY OF THE INVENTION

U.S. Pat. No. 6,325,253, assigned to the assignee of the present application, discloses a fluid dispensing closure, package and method of manufacture in which a housing has a base for securement to the finish of a container, and a peripheral wall extending from the base toward an open end spaced from the base. A flexible resilient liner is captured within the peripheral wall of the housing, and has a flange extending axially through the opening at the upper end of the housing. A flow tip is captured within the liner, and extends through the liner flange and the housing opening. In the preferred embodiment disclosed in the noted patent, the flow tip has a plurality of circumferentially spaced vanes, and fluid flow passages between the vanes extend from the base of the flow tip to the upper end of the flow tip beneath the flange of the liner. Pressure applied to the flange by fluid in the passages resiliently expands the flange away from the flow tip to permit egress of fluid from the passages, and removal of such fluid pressure allows resilient collapse of the liner over the ends of the passages. A general object of the present invention is provide a fluid dispensing closure, a closure and container package, and/or a method of making a closure of the type disclosed in the noted patent but having improved control of fluid discharge from the flow tip and/or improved support of the liner by the flow tip.

A fluid dispensing closure in accordance with one aspect of the present invention includes a housing having a base for securement to a container and a peripheral wall extending from the base toward an open end spaced from the base. A flexible resilient liner is captured within the peripheral wall of the housing, and has a flange extending through the open end of the housing peripheral wall. A flow tip has a body captured within the liner and an outer end extending through the open end of the housing peripheral wall and through the flange of the flexible resilient liner. The flow tip has at least two fluid flow passages disposed within the liner, and a circumferential channel underlying the flange and interconnecting ends of the passages. Pressure applied to the flange by fluid in the passages and channel expands the flange away from the flow tip and channel to permit egress of fluid from the channel, and removal of such pressure allows resilient collapse of the flange over the channel to seal the passages. The circumferential channel provides improved control of fluid flow from the dispensing closure.

A fluid dispensing closure in accordance with a second aspect of the invention, which may be implemented separately from or more preferably in combination with other aspects of the invention, includes a housing having a base for securement to a container and a peripheral wall extending from the base toward an open end spaced from the base. A flexible resilient liner is captured within the peripheral wall of the housing, and has a flange extending through the open end of the housing peripheral wall. A flow tip is captured within the liner and has an outer end extending through the open end of the housing peripheral wall and through the flange. The flow tip includes a plurality of circumferentially spaced vanes coupled to the outer end of the flow tip, with spaces between the vanes forming fluid flow passages from an inner end of the flow tip to the outer end. A ring interconnects ends of the vanes remote from the outer end of the flow tip. The ring provides a seating surface for an end of the liner remote from the flange, providing enhanced seating and stability for the lower end of the liner.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

The disclosure of above-noted U.S. Pat. No. 6,325,253 is incorporated herein by reference.

Figure 1:
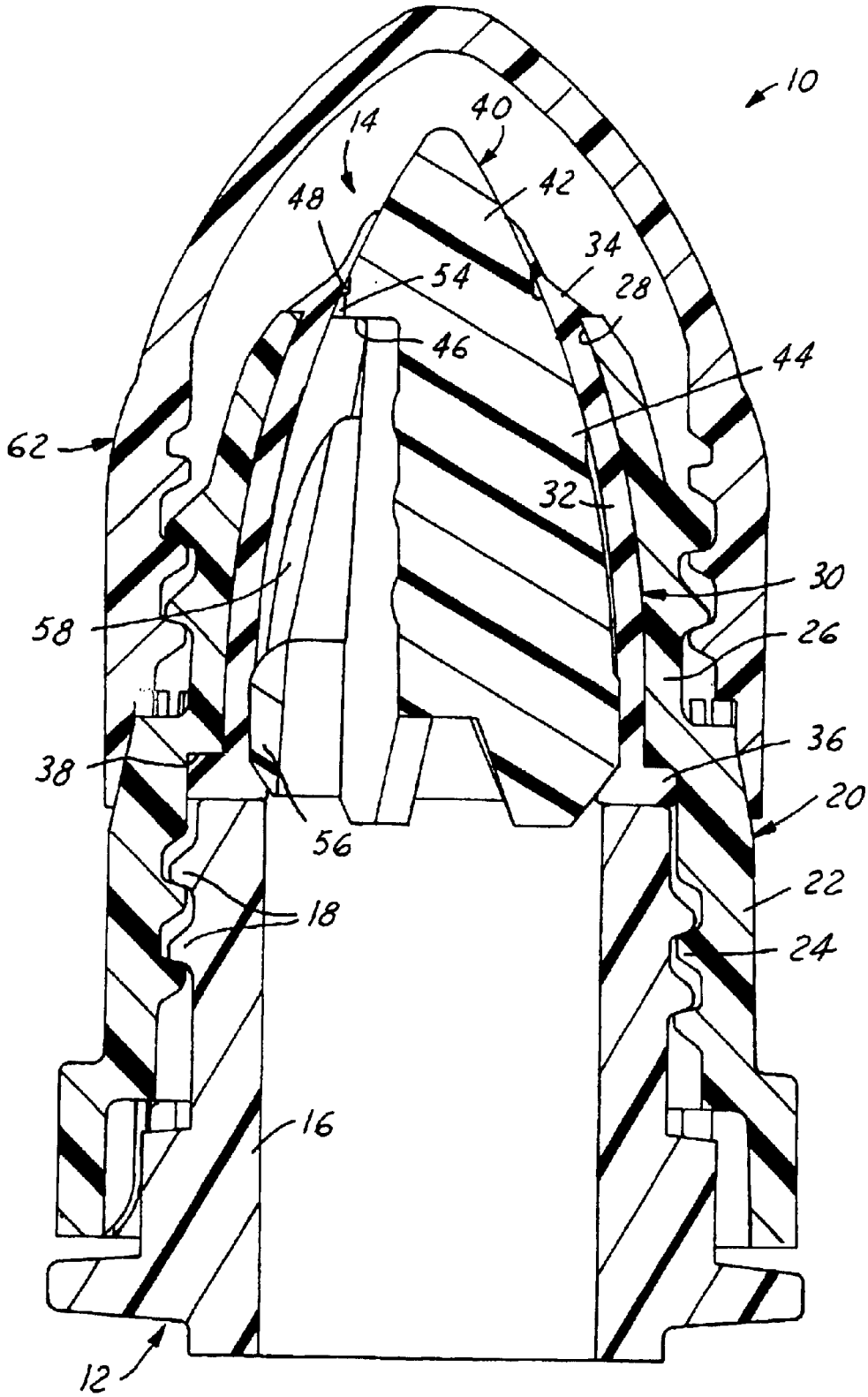
FIG. 1 is a fragmentary sectional view of a closure and container package in accordance with an exemplary but presently preferred embodiment of the invention.
Figure 2:
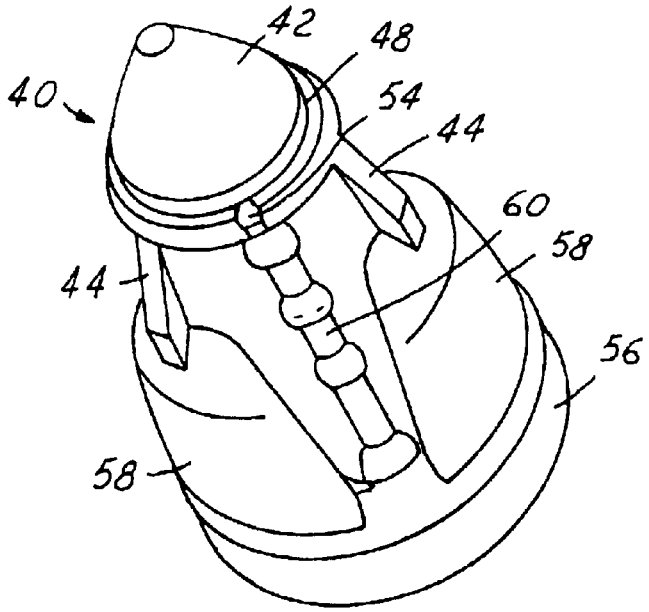
FIG. 2 is a perspective view of the flow tip in the dispensing closure of FIG. 1.
Figure 3:
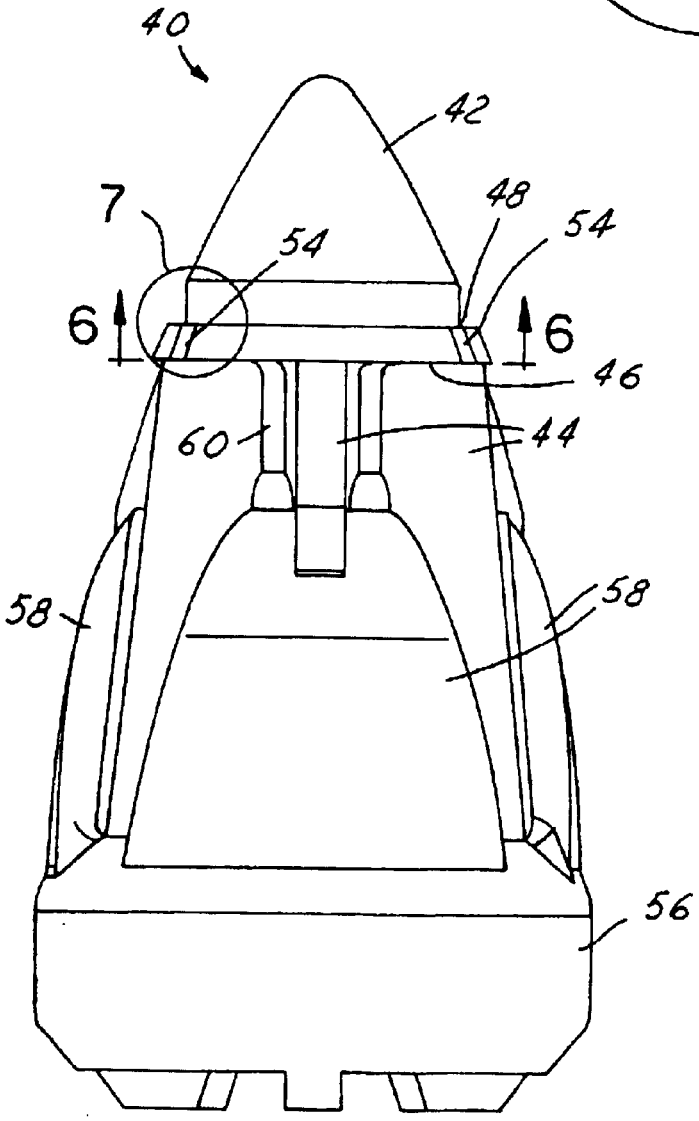
FIG. 3 is an elevational view of the flow tip illustrated in FIG. 2.
Figure 4:
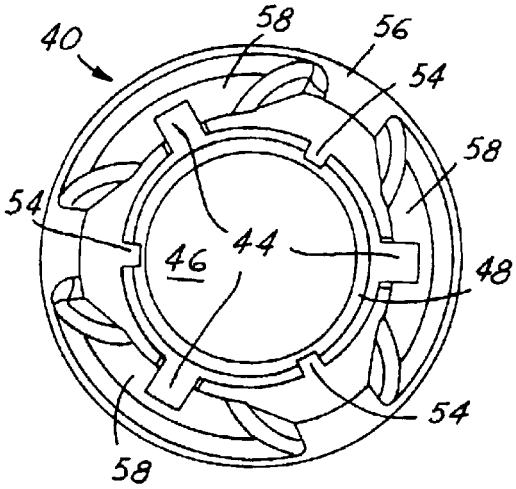
FIG. 4 is a top plan view of the flow tip illustrated in FIG. 3.
Figure 5:
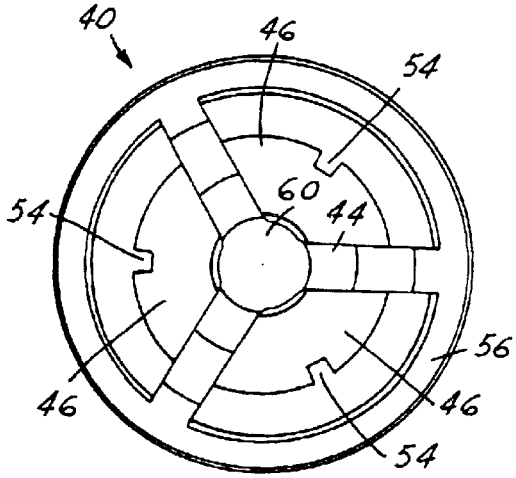
FIG. 5 is a bottom plan view of the flow tip illustrated in FIG. 3.
Figure 6:
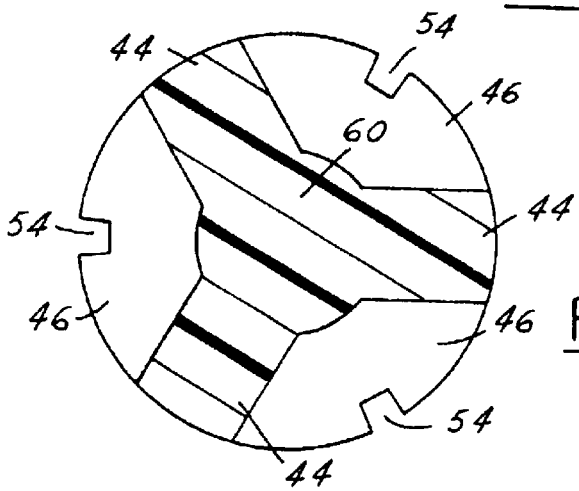
FIG. 6 is a sectional view taken substantially along the line 6—6 in FIG. 3.

FIG. 1 illustrates a fluid dispensing package 10, in accordance with an exemplary but presently preferred embodiment of the invention, as including a container 12 having a fluid dispensing closure 14 secured thereto. Container 12 includes a container body having an integral axially extending finish 16. Finish 16 has securement features, such as one or more external threads or beads 18, to which closure 14 is secured. Container 12 may be of any suitable construction, such as flexible resilient blow-molded construction. Container 12 may be of the type illustrated in U.S. Pat. No. 6,083,450, having an internal liner for containing the fluid to be dispensed and an atmospheric vent with a check valve to prevent creation of sub-atmospheric pressure (vacuum) between the liner and the container body. Other containers may also be employed as long as flow is initiated by application of pressure to the fluid within the container, such as by squeezing or pumping action, and little or no internal vacuum is created within the container as fluid is dispensed.

Closure 14 includes a housing 20 having a cylindrical base or skirt 22 with internal features, such as one or more threads or beads 24, for securement to container finish 16. A peripheral wall 26 coaxially extends from the housing base and converges toward a circular opening 28 at its upper or outer end spaced from the housing base. Circular opening 28 is coaxial with the housing axis and lies in a plane perpendicular to such axis. A circumferentially symmetrical flexible liner 30 has a body 32 captured within peripheral wall 26 of housing 20. Liner 30 has a flange 34 extending axially through opening 28 at the upper or outer end of housing peripheral wall 26. (Directional words such as "upper" and "lower" are employed by way of description and not limitation with respect to the upright orientation of the dispensing closure and package illustrated in FIG. 1. Directional words such as "outer" and "inner" are employed by way of description and not limitation with reference to the interior of the container. Directional words such as "radial" and "circumferential" are employed by way of description and not limitation with reference to the axis of the dispensing closure.) Flange 34 axially overlies the axially outer end of peripheral wall 26. A lower flange 36 extends radially outwardly from the lower end of liner body 32, and is captured beneath a shoulder 38 at the lower or inner end of housing peripheral wall 26 adjacent to base 22. Liner 30 is thus resiliently captured in assembly to housing 22 between flange 34 and flange 36.

Figure 7:
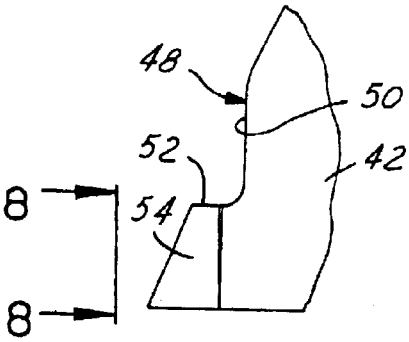
FIG. 7 is a fragmentary view on an enlarged scale of the portion of FIG. 3 within the area 7 in FIG. 3.
Figure 8:
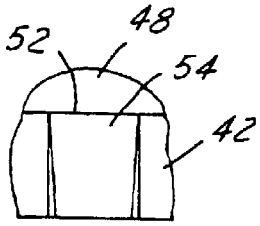
FIG. 8 is a fragmentary elevational view taken from the direction 8—8 in FIG. 7.

A flow tip 40 is captured within liner 30 and housing 20. Flow tip 40 preferably is a one-piece body having a solid upper or outer end 42 and a plurality of circumferentially spaced radial vanes 44 integrally axially extending from outer end 42. The spaces between vanes 44 terminate at surfaces 46 that define the underside of upper flow tip end 42. A circumferentially continuous external channel 48 extends around the outer surface of flow tip upper end 42 at a position axially spaced from surfaces 46. As best seen in FIG. 7, channel 48, which extends entirely around upper flow tip end 42, preferably is defined by a substantially radially facing wall surface 50 and a substantially axially facing wall surface 52, discounting surface draft angles that result from molding. The space between each adjacent pair of vanes 44 is connected to channel 48 by an external slot 54 that extends axially through the lower portion of flow tip end 42 at the peripheral edge of the flow tip. Vanes 44, which preferably comprise three vanes at 120° spacing from each other, thus cooperate with the inner surface of liner 30 to define fluid flow passages through the lower portion of the flow tip, which extend through slots 54 to channel 48. Flange 34 of liner 30 radially overlies channel 48 and slots 54 in assembly, as best seen in FIG. 1.

At the lower end of flow tip 40, a circumferentially continuous ring 56 interconnects the peripheral edges of vanes 44. Each vane 44 is connected to ring 56 by an arcuate buttress 58. Ring 56 thus stiffens vanes 44, particularly in cooperation with buttresses 58. Ring 56 underlies the lower end of liner 30 in assembly, as best seen in FIG. 1, and thus provides a seating surface to prevent radially inward collapse of the liner during use. Annular ring 56 also inhibits manual push-down of flow tip 40 by interference with the inner end of liner flange 36 and axial overlying relationship to container finish 16. This helps reduce the possibility of compromise of seal integrity. The radially inner ends of the vanes 44 are connected to a center post 60. Exemplary materials and methods of making housing 20, liner 30 and flow tip 40 are as discussed in above-referenced U.S. Pat. No. 6,325,253. A cap 62 may be secured over dispensing closure 14, such as by means of internal threads on cap 62 engaged with external threads on housing 20 as illustrated in FIG. 1.

To dispense fluid, the sidewall of container 12 is squeezed, the bottom wall of the container is depressed, or some other fluid pumping action is applied so that fluid within the container is urged under pressure through the passages between vanes 44, through slots 54 and into channel 48. The pressure of fluid within slots 54 and channel 48 applies an outward pressure to flange 34 of liner 30. (Package 10 may be inverted to dispense fluid such as eye drops.) Flange 34 is radially outwardly expanded by such fluid pressure, so that fluid may flow through the valve created by flange 34 for dispensing as desired. When fluid pressure is released, flange 34 collapses radially inwardly against the outer surface of flow tip upper end 42 over channel 48 and slots 54 so as to close the fluid passages. Any excess fluid that may remain on flow tip end 42 is prevented from returning to the container when the package is returned to the upright orientation of FIG. 1. Annular channel 48 allows fluid to gather in a single area from multiple inputs through slots 54 and the passages between the vanes to reduce the likelihood of producing multiple flows and creating multiple drops, for example, at flow tip end 42. Annular channel 48 also forms a pressure reduction area for modulating flow of fluid from the container by using a damming effect at flow slots 54, which reduces the incidence of squirting fluid from the package, as opposed to dispensing in drops where desired. Annular channel 48 also allows fluid flow to find a path of least resistance, providing a single flow resulting in a single drop from the flow tip and reducing actuation force by allowing reduced liner thickness at the seal over the channel.

There have thus been disclosed a fluid dispensing closure, a fluid dispensing closure and container package, and a method of making a fluid dispensing closure that fully satisfy all of the objects and aims previously set forth. The invention has been disclosed in conjunction with an exemplary but presently preferred embodiments thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A fluid dispensing closure that includes:

a housing having a base for securement to a container, and a peripheral wall extending from said base toward an open end spaced from said base, a flexible resilient liner captured within said peripheral wall of said housing, said liner having a flange extending through said open end, a flow tip having a body captured within said liner and an outer end extending through said open end and through said flange, at least two flow passages within said liner, and a circumferential channel on said flow tip underlying said flange and interconnecting ends of said passages, such that pressure applied to said flange by fluid in said passages and said channel expands said flange away from said flow tip and channel to permit egress of fluid from said channel, and removal of such pressure allows resilient collapse of said flange over said channel to seal said passages.

2. The closure set forth in claim 1 wherein said at least two passages are formed by circumferentially spaced vanes in said flow tip body, and wherein said flow tip includes a ring interconnecting said vanes and providing a seating surface for said liner.

3. The closure set forth in claim 1 wherein said at least two passages are formed by circumferentially spaced vanes on said flow tip body, wherein said flow tip end is coupled to said vanes, and wherein said end includes external slots extending from said channel and interconnecting said channel with flow passages between said vanes.

4. The closure set forth in claim 3 wherein said outer end of said flow tip is conical, having an axis coaxial with said flow tip body, said channel having a first wall coaxial with said axis and a second wall perpendicular to said axis.

5. The closure set forth in claim 3 wherein said flow tip body includes a ring interconnecting said vanes at an end of said vanes remote from said tip, said ring providing an internal seating surface for an end of said liner remote from said flange.

6. The closure set forth in claim 5 wherein said flow tip body includes buttresses connecting ends of said vanes to said ring.

7. A fluid dispensing closure that includes:

a flow tip having an exterior peripheral surface and at least two fluid passages extending along said exterior peripheral surface from an inner end of said flow tip to a position adjacent to an outer end of said flow tip, and an exterior channel around said flow tip interconnecting ends of said passages adjacent to said outer end of said flow tip, a liner of flexible resilient construction embracing said exterior surface of said flow tip forming outer walls of said at least two passages, and having an outer end that overlies and closes said channel, and a housing exteriorly securing said liner to said flow tip, said outer end of said liner and said outer end of said flow tip extending through an outer end of said housing, such that pressure applied by fluid in said at least two passages resiliently expands said outer end of said liner away from said outer surface of said flow tip to permit egress of fluid from said at least two passages, and removal of pressure applied by fluid in said at least two passages allows collapse of said outer end of said liner over said channel to prevent return of fluid to said passages.

8. The dispensing closure set forth in claim 7 wherein said at least two passages are formed between circumferentially spaced vanes on said flow tip body, and wherein said flow tip includes a ring interconnecting said vanes and providing a seating surface for said liner.

9. The dispensing closure set forth in claim 7 wherein said at least two passages are formed between circumferentially spaced vanes on said flow tip body, wherein said flow tip end is coupled to said vanes, and wherein said end includes external slots extending from said channel and interconnecting said channel with flow passages between said vanes.

10. The dispensing closure set forth in claim 9 wherein said outer end of said flow tip is conical, having an axis coaxial with said flow tip body, said channel having a first wall coaxial with said axis and a second wall perpendicular to said axis.

11. A fluid dispensing closure that includes:

a housing having a base for securement to a container, and a peripheral wall extending from said base toward an open end spaced from said base, a flexible resilient liner captured within said peripheral wall of said housing, said liner having a flange extending through said open end, and a flow tip captured within said liner and having an outer end extending through said open end and through said flange, said flow tip including a plurality of circumferentially spaced vanes coupled to said outer end, spaces between said vanes forming fluid flow passages from an inner end of said flow tip to said outer end, and a ring interconnecting ends of said vanes remote from said outer end, said ring providing a seating surface for an end of said liner remote from said flange.

12. A closure and container package that includes:

a container having a finish for securement of a closure, and a fluid dispensing closure that includes:

a housing having a base secured to said container, and a peripheral wall extending from said base toward an open end spaced from said base, a flexible resilient liner captured within said peripheral wall of said housing, said liner having a flange extending through said open end, a flow tip having a body captured within said liner and an outer end extending through said open end and through said flange, at least two flow passages within said liner, and a circumferential channel on said flow tip underlying said flange and interconnecting ends of said passages, such that pressure applied to said flange by fluid in said passages and said channel expands said flange away from said flow tip and channel to permit egress of fluid from said channel, and removal of such pressure allows resilient collapse of said flange over said channel to seal said passages.

13. The package set forth in claim 12 wherein said at least two passages are formed by circumferentially spaced vanes in said flow tip body, and wherein said flow tip includes a ring interconnecting said vanes and providing a seating surface for said liner.

14. The package set forth in claim 12 wherein said at least two passages are formed by circumferentially spaced vanes on said flow tip body, wherein said flow tip end is coupled to said vanes, and wherein said end includes external slots extending from said channel and interconnecting said channel with flow passages between said vanes.

15. The package set forth in claim 14 wherein said outer end of said flow tip is conical, having an axis coaxial with said flow tip body, said channel having a first wall coaxial with said axis and a second wall perpendicular to said axis.

16. A method of making a fluid dispensing closure that includes the steps of:

(a) providing a housing having a base for securement to a container finish, and a peripheral wall extending from said base and converging toward an opening spaced from said base, (b) securing within said housing peripheral wall a flexible resilient liner having a flange extending axially through said opening, and (c) securing within said liner a flow tip having a body with at least two flow passages and a tip that extends through said flange and said housing opening, said tip having a circumferential external channel extending entirely around said tip underlying said flange and interconnecting said passages.

* * * * *